US008166677B1

(12) United States Patent
Woyak

(10) Patent No.: US 8,166,677 B1
(45) Date of Patent: May 1, 2012

(54) MANUAL SNOW PLOW

(76) Inventor: Thomas L. Woyak, Dousman, WI (US)

( * ) Notice: Subject to any disclaimer, the term of this patent is extended or adjusted under 35 U.S.C. 154(b) by 181 days.

(21) Appl. No.: 12/724,978

(22) Filed: Mar. 16, 2010

(51) Int. Cl.
*E01H 5/02* (2006.01)

(52) U.S. Cl. ..... 37/265; 37/285; 294/54.5; 294/58

(58) Field of Classification Search ..... 37/265, 37/278, 284, 285; 294/54.5, 55, 53.5, 57, 294/58
See application file for complete search history.

(56) References Cited

U.S. PATENT DOCUMENTS

| | | | | | |
|---|---|---|---|---|---|
| 187,222 | A | * | 2/1877 | Dowler | 172/346 |
| 830,871 | A | * | 9/1906 | Wilken | 37/283 |
| 1,009,824 | A | * | 11/1911 | Birdsong | 172/353 |
| 1,473,572 | A | * | 11/1923 | Fitzgerald | 37/434 |
| 2,388,985 | A | | 11/1945 | Martin | |
| 2,736,330 | A | * | 2/1956 | Wood | 135/68 |
| 2,771,089 | A | * | 11/1956 | Magida | 135/69 |
| 3,768,495 | A | * | 10/1973 | Smith | 135/72 |
| 4,033,055 | A | * | 7/1977 | Lazarecky | 37/230 |
| 4,103,954 | A | * | 8/1978 | Vaslas | 294/54.5 |
| D267,468 | S | * | 1/1983 | Simms | D8/10 |
| 4,721,125 | A | * | 1/1988 | Wang-Lee | 135/69 |
| 4,772,057 | A | | 9/1988 | Harvey | |
| 4,787,661 | A | * | 11/1988 | Rutledge | 294/58 |
| 4,878,704 | A | * | 11/1989 | Jacanin et al. | 294/54.5 |
| 4,910,893 | A | * | 3/1990 | Asay | 37/281 |
| 4,991,324 | A | * | 2/1991 | Fine et al. | 37/284 |
| 5,018,282 | A | * | 5/1991 | Hong | 37/434 |
| 5,048,883 | A | * | 9/1991 | Waluk | 294/54.5 |
| 5,197,772 | A | * | 3/1993 | Stecyk | 294/57 |
| 5,476,299 | A | * | 12/1995 | Whaley | 294/55 |
| 5,493,797 | A | * | 2/1996 | Jackson | 37/285 |
| 5,581,915 | A | * | 12/1996 | Lobato | 37/285 |
| D405,665 | S | * | 2/1999 | Whitehead et al. | D8/10 |
| 6,053,548 | A | * | 4/2000 | Bowles, Jr. | 294/54.5 |
| 6,085,766 | A | * | 7/2000 | Geary | 135/75 |
| 6,412,841 | B1 | * | 7/2002 | Loraas et al. | 294/51 |
| 6,457,757 | B2 | * | 10/2002 | Hendrick | 294/54.5 |
| 6,592,160 | B1 | * | 7/2003 | Nicolay et al. | 294/57 |
| 7,237,814 | B2 | * | 7/2007 | Handzlik | 294/54.5 |
| 2007/0013198 | A1 | * | 1/2007 | Brazeau | 294/54.5 |

* cited by examiner

*Primary Examiner* — Thomas Beach
*Assistant Examiner* — Matthew Buck
(74) *Attorney, Agent, or Firm* — Montgomery Patent & Design, LLC; Robert C. Montgomery; Joseph T. Yaksich

(57) ABSTRACT

A manual snow plow with ergonomic features comprises a snow scoop, two (2) articulating struts extending upward from the scoop and two (2) hinged rounded braces placed against a user's shoulders during use. The struts are provided with cross bracing which provide size adjustability and stability to the plow. A set of position adjustable hand grips extend from each strut in a rearward fashion to control the device during use. A pair of casters provided on a rear of the snow scoop allows the device to ride over cracks and other uneven surface variations. The snow plow becomes an extension of the user's body and thus enables the user to use the force of their entire body to move snow.

17 Claims, 5 Drawing Sheets

MANUAL SNOW PLOW

RELATED APPLICATIONS

The present invention was first described in a notarized Official Record of Invention on Nov. 21, 2008, that is on file at the offices of Montgomery Patent and Design, LLC, the entire disclosures of which are incorporated herein by reference.

FIELD OF THE INVENTION

The present invention relates generally to snow removal devices, and more particularly, to a manual snow plow

BACKGROUND OF THE INVENTION

Those who live in areas where the winter climate brings snow, know all too well of the work associated with the snow removal process. Those that must remove snow from driveways, sidewalks, and porches, typically utilize a snow shovel to help in this process. Snow shovel design typically includes an elongated handle having a wide shovel blade with various degrees of curved surfaces. While snow shovels work, they are not without disadvantages. One (1) of these disadvantages is the risk of back pain or injury that may result from lifting heavy loads of snow. During snow removal process the user is forced to bend over, scoop an amount of snow with the shovel, and lift and throw the snow to desired location. Even if injury is avoided, the process is tiring and time consuming. It is thus easy to see that when coupled with cold weather, large amounts of snow, and frequent snow removal schedules, the process can become quite daunting.

Some attempts to improve upon the snow shovel can be seen by reference in the following U.S. Pat. Nos. 4,103,954, issued in the name of Vaslas, describes a snow shovel having an auxiliary handle to enable a user to shovel snow without having to bend over; and, 4,772,057, issued in the name of Harvey, describes a balanced snow shovel to enable the user to lift snow with more ease and without suffering back strain. These designs are unsatisfactory, making it very difficult to push or plow snow and limit the amount of snow which can be removed for a given amount of effort.

The pushing or "plowing" motion enables the user to remove much more snow without having to lift the snow off the ground. Attempts have been made to provide devices which enable the user to push snow to the side instead of having to shovel it and can be seen by example in the following U.S. Pat. Nos. 2,388,985, issued in the name of Martin, describes an adjustable two-way hand snow plow; 4,910,893, issued in the name of Asay, describes a manually operated snow plow or other utility device; 5,048,883, issued in the name of Waluk, describes a snow shovel/scraper; 5,493,797, issued in the name of Jackson, describes a wheeled plow shovel; 5,581,915, issued in the name of Labato, describes a snowplow carriage assembly for manual snow removal; 6,053,548, issued in the name of Bowles, Jr., describes a manually-operated combination shovel and plow for snow and other material. However, these examples are unsatisfactory to achieve the maximum amount of snow removal proportional to the amount of effort used in that they are not properly designed to harness the full force of the user and they fail to allow for proper adjustment for the varying sizes of different users.

The disclosures of the above referenced examples are incorporated herein by reference. Each of these prior attempts suffers from one (1) or more of the aforementioned disadvantage or deficiency with respect to design, function, or effectiveness. Accordingly, there exists a need for a means by which the risk of back pain or injury while using a snow shovel can be greatly reduced while increasing the efficiency of the snow removal process. The development of the present invention substantially departs from the conventional solutions and in doing so fulfills this need.

SUMMARY OF THE INVENTION

In view of the foregoing art, the inventor recognized the aforementioned inherent problems and observed that there is a need for a means by which the risk of back pain or injury while using a snow shovel can be greatly reduced while increasing the efficiency of the snow removal process, the object of the present invention is to solve the aforementioned disadvantages and provide for this need.

Another object of the present invention is to provide a device which functions like a snow plow, utilizing the increased pushing force which can be exerted by the entire body of the user instead of only the arms and back.

Another object of the present invention is to provide a device which can be properly adjusted to fit the particular shoulder width and height and arm length of the user, thereby providing a more comfortable and ergonomic snow removal tool.

Another object of the present invention is to provide a device which can comfortably accept the shoulders of the user to provide much of the plowing force.

Another object of the present invention is to provide a device which can be used to remove large amounts of snow quickly and easily by simply pushing the snow off of a surface.

Another object of the present invention is to provide a device which can easily maneuver over irregular bumps and cracks in a surface which is in need to snow removal.

Another object of the present invention is to provide a device which can set the plowing angle of the snow scoop to a selected angle in relation to a user-engaged frame.

Yet another object of the present invention is to provide a device which is simple and intuitive to use with little to no training and can be used effectively by a single user.

Yet another object of the present invention is to provide a device which is simple and economical to manufacture.

Accordingly, the above objectives and advantages are achieved by an apparatus comprising features which provide a scoop for pushing snow from a surface, a frame that is pivotally attached to the scoop for transferring a force exerted by a user to the scoop, a means to adjust a width of the frame to suit a particular shoulder width of the user; and a means to adjust a height of the frame to suit a particular height of the user. The frame includes a pair of outer struts having a lower ends that is pivotally connected to the scoop, a pair of inner struts having lower ends in a telescoping relationship with open upper ends of the outer struts, a pair of curved shoulder braces that are pivotally connected to upper ends of the inner struts, a pair of hand grips that are adjustably attached to under side surfaces of the outer struts, and a pair of wheel assemblies for guiding the scoop over uneven areas of the surface.

In one (1) embodiment, the device provides the scoop including a receptacle having a transverse curved rear wall joining the side walls and the top and an open face, a blade attached to a lower end of the rear wall to scrape the surface and push said snow into the receptacle, a means to adjustably secure the blade to the receptacle at a desired forward position and scraping angle, and a means to pivotably attach said frame to said scoop.

In further embodiments the device provides the scoop including a shovel blade to scrape the surface, a means to pivotably attach the frame to the shovel blade, and an articulation means to selectively adjust a position of the shovel blade to a selectable angle in relation to the frame.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | snow plow |
| 11 | scoop |
| 12 | blade |
| 13 | caster |
| 14 | caster bracket |
| 15 | detent pin |
| 16 | detent pin aperture |
| 17 | blade clamp |
| 18 | clamp fastener |
| 19 | adjusting apertures |
| 21a | first fixed strut |
| 21b | second fixed strut |
| 22 | cross-member bracket |
| 23 | first cross-member |
| 24 | first pivot pin |
| 25 | second cross-member |
| 26 | strut receptacle |
| 27a | first hand grip |
| 27b | second hand grip |
| 28 | adjustment rail |
| 29 | clamping washer |

-continued

| | |
|---|---|
| 31 | telescoping strut |
| 32 | shoulder brace clevis |
| 33 | shoulder brace |
| 34 | padding |
| 35 | second pivot pin |
| 40 | alternate snow plow |
| 41 | snow blade |
| 42 | blade clevis |
| 43 | guide |
| 44 | caster assembly |
| 45 | strut clevis |
| 46 | guide apertures |
| 47 | blade pivot pin |
| 48 | beam |
| 49 | guide clevis |
| 60 | user |
| 61 | snow |

DETAILED DESCRIPTION OF THE PREFERRED EMBODIMENT

Figure 3A:
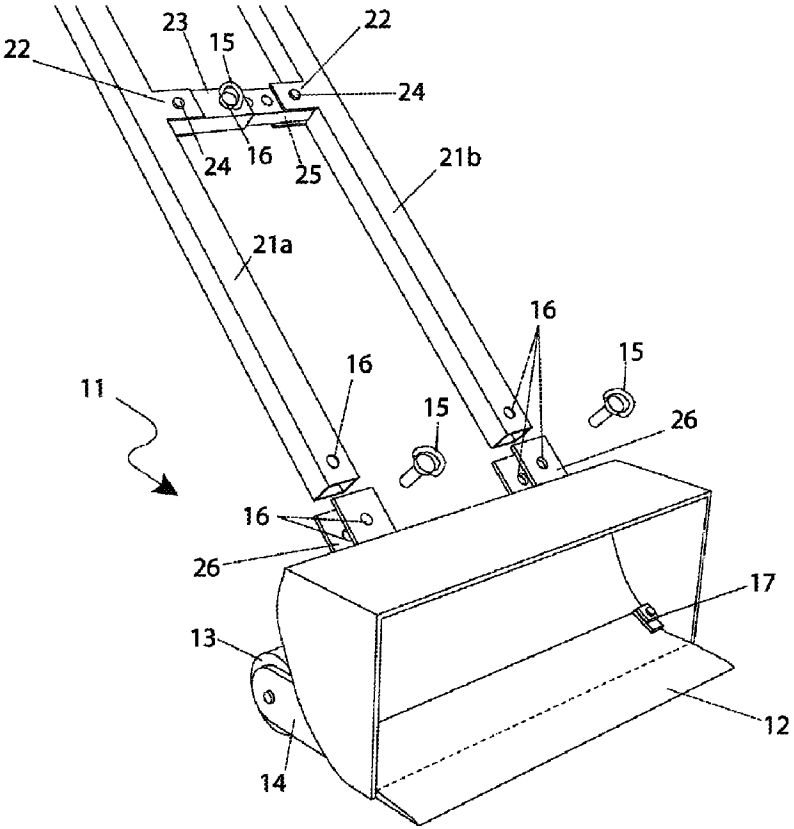
FIG. 3A is a perspective view of a lower end of the snow plow 10, according to a preferred embodiment of the present invention.
Figure 3B:
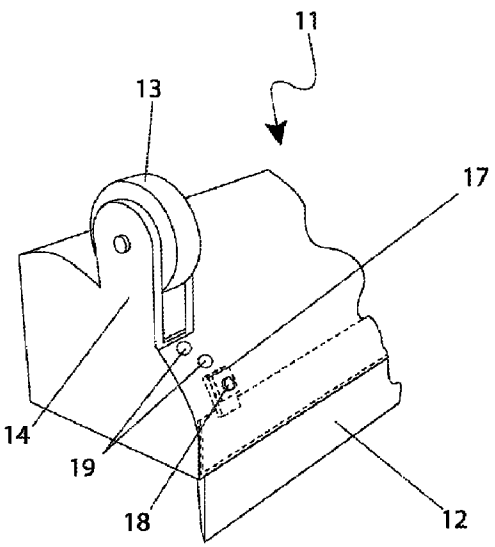
FIG. 3B is a detailed perspective view of a lower end of the snow plow 10, according to a preferred embodiment of the present invention.
Figure 4B:
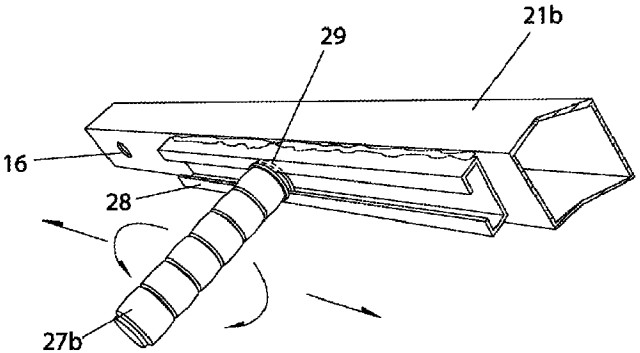
FIG. 4B is a perspective bottom view of a hand grip of the snow plow 10, according to a preferred embodiment of the present invention; and, FIG. 5 is a perspective of 4 snow plow 40, according to an alternate embodiment of the present invention.
Figure 4A:
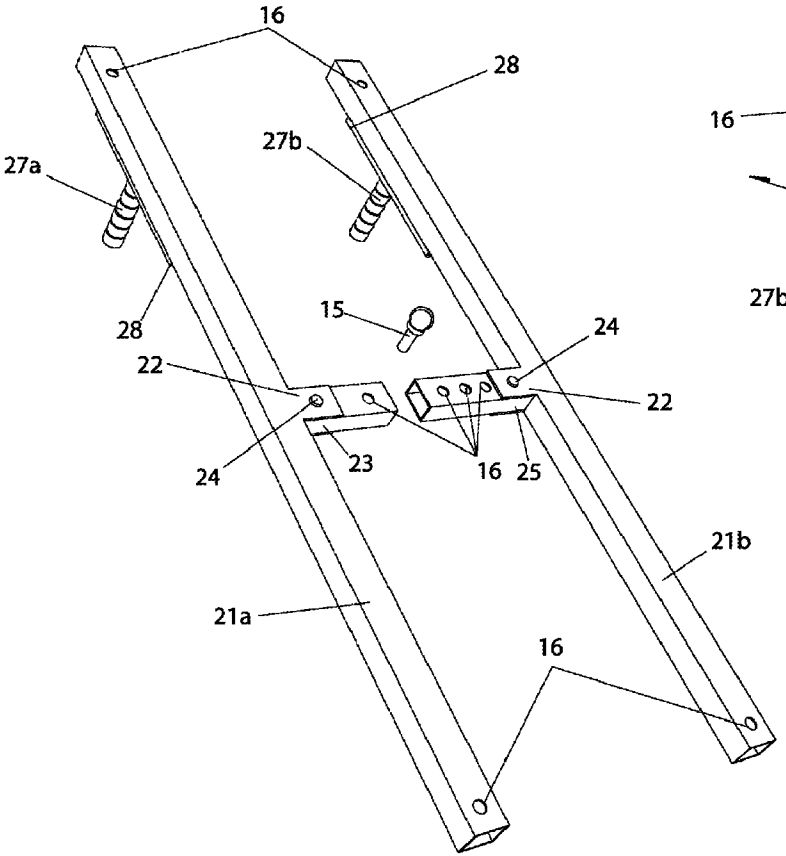
FIG. 4A is a perspective view of a pair of the fixed strut of the snow plow 10, according to a preferred embodiment of the present invention.
Figure 5:
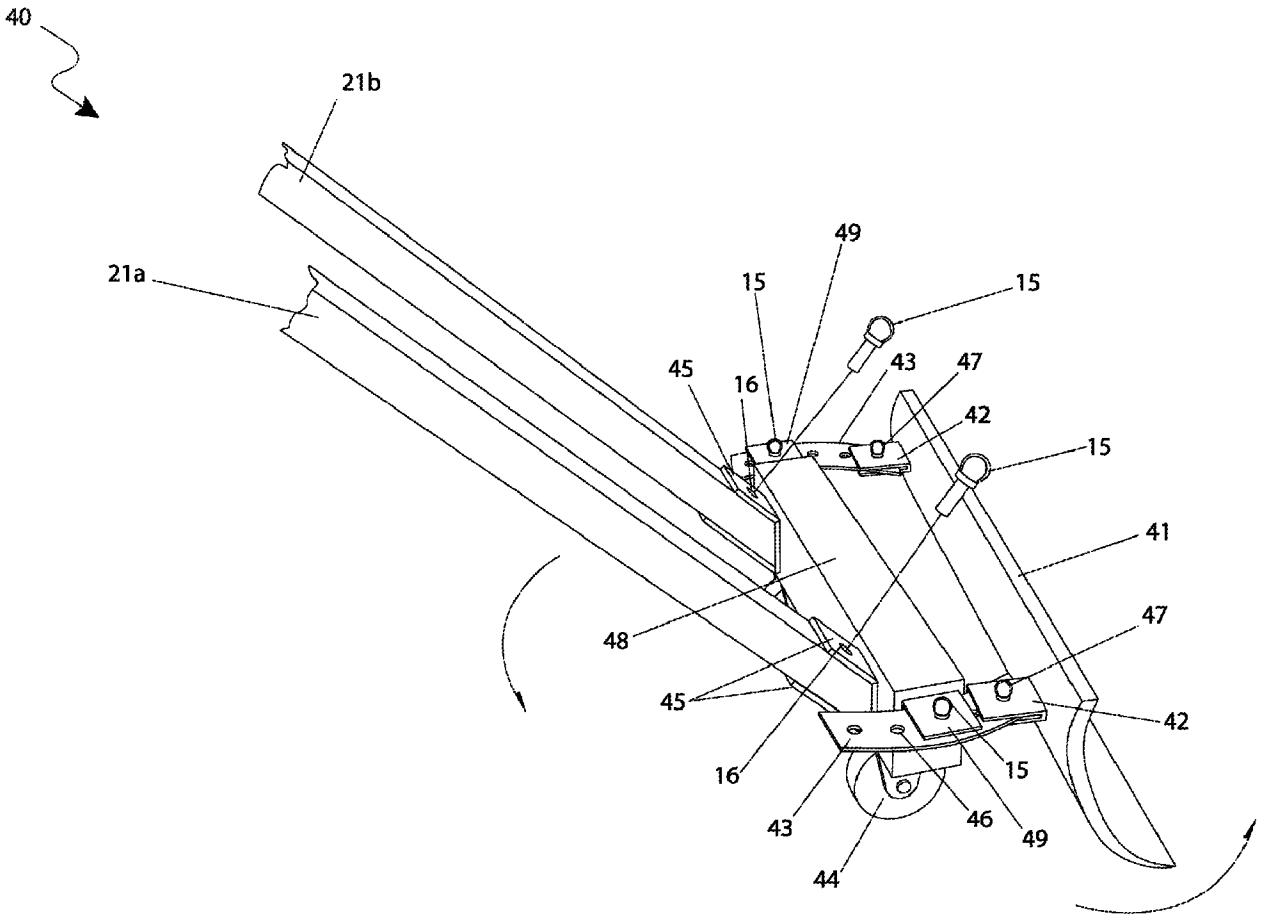

The best mode for carrying out the invention is presented in terms of its preferred embodiment, herein depicted within FIGS. 1 through 4B, and in terms of an alternate embodiment within FIG. 5. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a snow plow (herein described as the "device") 10, which provides a means for applying a user's body weight as an assist in providing a safer and more effective manual snow removal operation.

Figure 1:
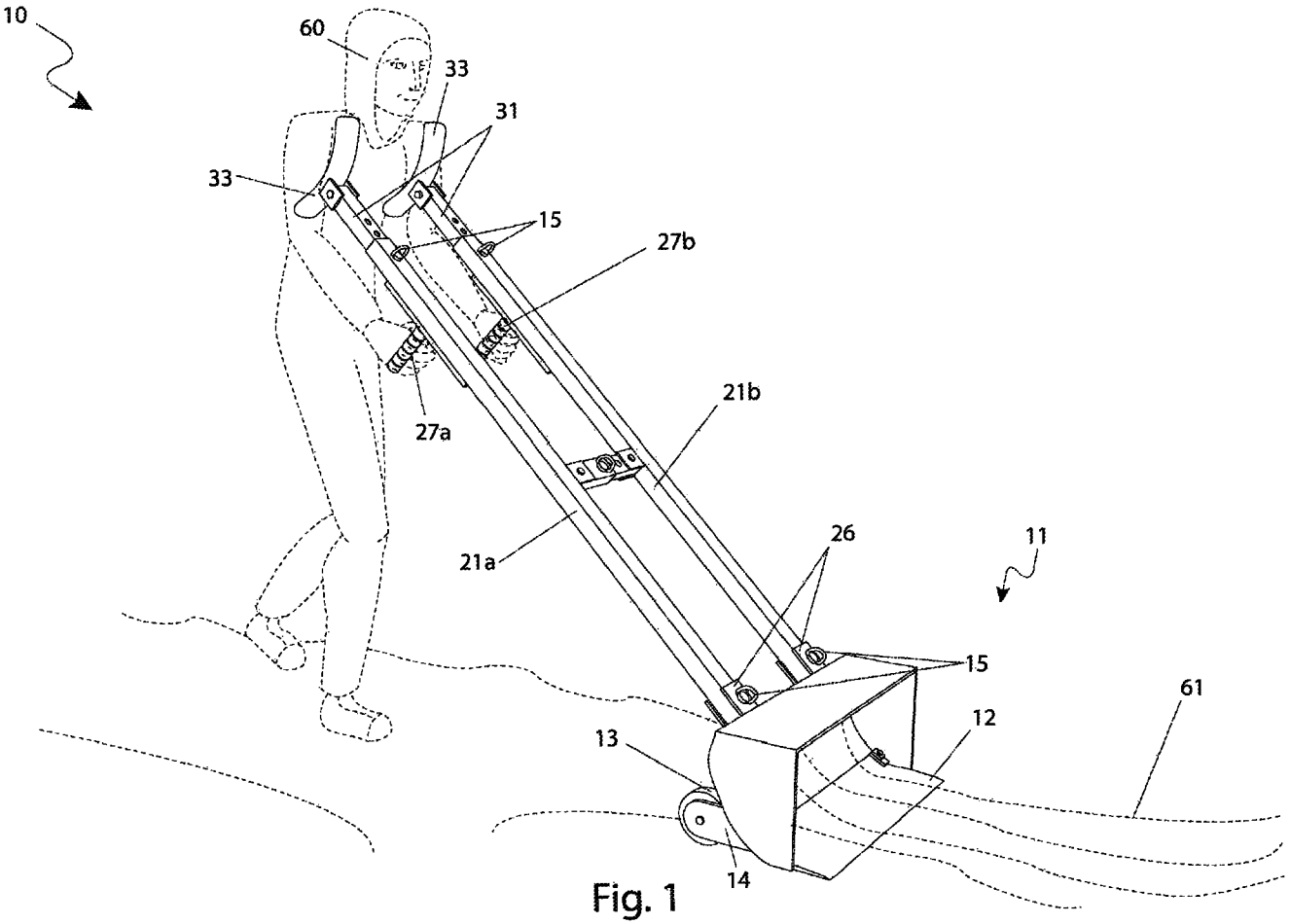
FIG. 1 is an environmental view of a snow plow 10, according to a preferred embodiment of the present invention.

Referring now to FIG. 1, an environmental view of a device 10, according to a preferred embodiment of the present invention, is disclosed. The device 10 is shown in a snow 61 removal operation whereby the weight of a user 60 is applied onto a pair of shoulder braces 33 providing a high degree of mechanical advantage, thus enabling the user the ability to more easily and more safely move larger quantities of snow 61 than is feasible by using a standard snow shovel. A pair of adjustable hand grips 27*a*, 27*b* allows the user 60 to maintain an ergonomic position and stabilize the device 10.

Figure 2:
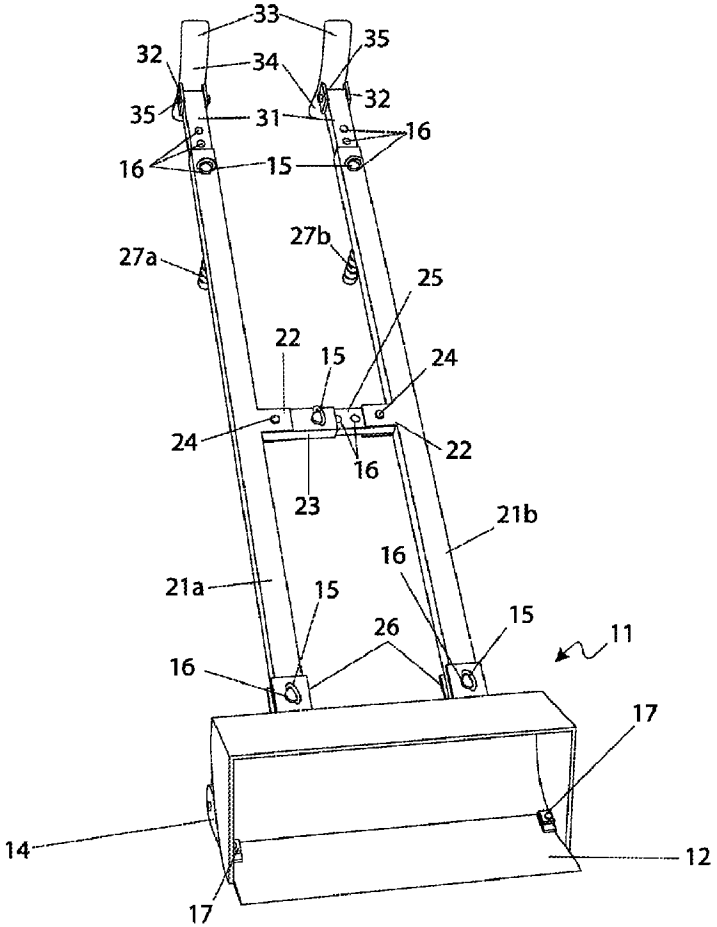
FIG. 2 is a perspective view of the snow plow 10, according to a preferred embodiment of the present invention.

Referring now to FIG. 2 perspective view of the assembled device 10, according to the preferred embodiment of the present invention, is disclosed. The device 10 comprises a scoop 11, a blade 12, and a pair of casters 13, wherein each caster is contained within a caster bracket 14 located at opposing bottom rear outer center portions of the scoop 11. The scoop 11 further comprises a pair of strut receptacles 26 which allow the pair of fixed struts 21*a*, 21*b* to be pivotally connected onto the scoop 11 by means of a pair of detent pins 15 inserted into corresponding detent pin apertures 16. An upper end of each fixed strut 21*a*, 21*b* encloses a lower portion of a telescoping strut 31, while an upper end of each telescoping strut 31 comprises the curved shoulder brace 33 which is pivotally connected onto the telescoping strut 31 by means of a clevis 32 and a second pivot pin 35. Each shoulder brace 33 is provided with a padding 34, thereby providing the user 60 with comfortable means of applying weight onto the device 10 while plowing the snow 61. Each fixed strut 21*a*, 21*b* comprises a clevis-like cross member bracket 22 permanently affixed symmetrically onto opposing face portions of the fixed struts 21*a*, 21*b*. A first cross-member 23 is pivotally affixed within the bracket 22 of a first fixed strut 21*a* and secured by a pivot pin 24 permanently fixed within an aperture through the top and bottom member of the bracket 22, and through the end portion of the first cross member 23. The outer end of the first cross-member 23 encloses a first end portion of a telescoping second cross-member 25. The opposite end portion of the second cross-member 25 is pivotally affixed within the corresponding bracket 22 of a second fixed strut 21*b*, and similarly secured by a pivot pin 24 inserted through an aperture within the bracket 22 and the end portion of the second cross-member 25.

The telescoping connection between the first cross-member 23 and the second cross-member 25 allows for adjusting the spacing between the pair of fixed struts 21 to a desired shoulder spacing of the user 60, wherein another detent pin 15 is inserted through the detent pin aperture 16 within the first cross-member 23 and through one (1) of a plurality of apertures 16 within the second cross-member 25. The pivotal connections within the pair of strut receptacles 26, the pair of cross-member brackets 22, and the pair of brace devises 32 are intended to ensure the freedom of each corresponding member to accommodate an optimal ergonomic orientation. Each of the pair of fixed struts 21*a*, 21*b* further comprises a hand-grip 27*a*, 27*b* adjustably mounted onto the bottom portion of the upper end of each strut 21*a*, 21*b* by means of an adjustment rail 28.

It is envisioned that the various components of the device 10, except the blade 12, are made of materials such as, but not limited to: steel, aluminum, fiberglass, plastics, or the like, whereby the components are all made either of the same material, or in a suitable combination of materials. The blade 12 is intended to be made of a wear resistant plastic or of a heat treated steel. The struts 21*a*, 21*b* and 31, and the cross-members 23 and 25 are envisioned to be made as light weight tubular configurations, either square, rectangular or round, either fabricated from commercial shapes, or produced as extruded shapes.

Referring now to FIG. 3A, a perspective view of the bottom portion of the device 10, according to the preferred embodiment of the present invention, is disclosed, wherein the assembly of the pair of fixed struts 21*a*, 21*b* and the cross-members 23 and 25 is depicted in a state of being disconnected from the scoop 11. Each strut receptacles 26, cross-member bracket 22, and shoulder brace clevis 32 comprise a pair of plates or strips which are appropriately spaced and permanently affixed onto their corresponding member by welding or chemical bonding. Alternately, these receptacles 26, brackets 22 and devises 32 can be either formed as an integral part of its corresponding member, or be molded or formed into an appropriate "U"-shape which is removably or permanently affixed onto its corresponding member. Likewise, the caster brackets 14 intended to be either integral members of the scoop 11, conventional commercial brackets, or made as a "U"-shaped configuration, wherein the commercial brackets or the "U"-shaped configurations are permanently affixed or removeably attached onto the bottom portion of the scoop 11. The blade 12 is intended to be removably fastened within a lower interior portion of the scoop 11 by means of a pair of blade clamps 17. Each blade clamp 17 is secured by means of a fastener 18 which is inserted through one (1) of a plurality of adjusting apertures 19 and threaded into the blade clamp 17. The adjusting apertures provide a means of adjusting the amount the blade 12 is protruding beyond the edge of the scoop 11. Since adjusting the protrusion of blade 12 moves it inwardly or outwardly against the curved interior surface of the scoop 11, this adjustment additionally produces a variation of the angle of the blade 12.

Referring now to FIG. 3B, a perspective detailed bottom view of one (1) end portion of the scoop 11 of the device 10, according to the preferred embodiment of the present invention, is disclosed. The detailed view depicts the caster 13, the caster bracket 14, and the blade 12 protruding beyond the bottom edge of the scoop 11. Additionally, FIG. 3B depicts the blade clamp 17, the clamp fastener 18 and the adjusting apertures 19. The pair of blade clamps 17 securely fastens the blade 12 onto the bottom inside portion of the scoop 11 by means of a pair of fasteners 18, each passing through one (1) corresponding adjusting aperture 19 and tightened by engaging a threaded aperture provided within the clamp fastener 18.

Referring now to FIG. 4A, a perspective view of the fixed struts 21 of the device 10, according to the preferred embodiment of the present invention, is disclosed. The fixed struts 21*a*, 21*b* are depicted in a disassembled state, which more clearly depicts the pivotal and telescoping disposition of the cross-bracing struts 23, 25. The upper end portion of each fixed strut 21*a*, 21*b* comprises a hand grip 27*a*, 27*b*, wherein an adjustment rail 28 and a clamping washer 29 provide the means for adjusting and securely locking each hand grip 27*a*, 27*b* in a desired upward or downward direction.

Referring now to FIG. 4B, a perspective bottom view of the hand grip 27 adjustment portion of the device 10, according to the preferred embodiment of the present invention, is disclosed. Each hand grip 27*a*, 27*b* is envisioned to be covered by a comfortable semi-soft material which is not affected by snow and cold temperatures, such as, but not limited to: rubber, fabric or plastic. Additionally, the upper end of each hand grip 27*a*, 27*b* comprises a threaded extension inserted within a corresponding threaded aperture within a clamping washer 29. A clockwise rotation of each hand grip 27*a*, 27*b* allows it to be securely locked in place by drawing the clamping washer 29 against an inside portion of the adjustment rail 28.

Referring now to FIG. 5, a perspective view of a device 40, according to an alternate embodiment of the present invention, is disclosed. The device 40, which is intended to be used in conjunction with the strut configuration which is similar to the one depicted for the device 10, comprises a beam 48, a snow blade 41, a pair of blade devises 42, a pair of commercial caster assemblies 44, and a pair of strut devises 45 intended to receive the bottom end portion of the fixed struts 21. The assembly of the beam 48, and the pair of caster assemblies 44 fastened onto the bottom outside corners of the beam 48, constitutes a chassis which supports the pair of strut devises 45 fastened onto the rear face portion of the beam 48, and a pair of guide devises 49 fastened onto opposing end face portions of the beam 48. The snow blade 41 comprises a pair of blade devises 42 fastened onto opposing outside rear portions of the blade 41 adjacent to the outer edge, each comprising a curved pivotally mounted guide 43 extending through a guide clevis 49 and secured by a detent pin 15. This alternate embodiment 40 is designed to allow the snow blade to be set at an angle intended to deflect the snow 61 into a desired direction, to secure the desired setting by means of the pair of detent pins 15, inserted in the guide clevis detent pin aperture and one (1) of a plurality of guide apertures 46. The design of this alternate embodiment 40 allows the weight of the user 60 to be ergonomically applied in a manner which is similar to that of the device 10 through the similar assembly of the shoulder braces 33, the telescoping struts 31, and the fixed struts 21*a*, 21*b* even with the snow blade 41 positioned at any of the possible angles.

Additionally, alternative embodiments of the present invention 10 may comprise a variety of alternate snow 61 moving configurations, in addition to the scoop 11 depicted for the device 10 within FIGS. 1 through 4B, and the snow blade 41 depicted for the alternate device 40 within FIG. 5. However, the invention 10 is not limited to the described embodiments, as alternate configuration would include, but not be limited to: "V"-shapes, flat board-like, condition specific curvatures, and serrated leading edge.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 2A.

The method of utilizing the device 10 may be achieved by performing the following steps: inspecting all parts; ascertaining the presence of all accessories; installing the first fixed strut 21*a* into its corresponding strut receptacle 26; making sure the pivotally attached first cross-member 23 is pointed in an inward direction; securing the first fixed strut 21*a* within its receptacle 26 by means of a first detent pin 15; installing the second fixed strut 21*b* into its corresponding strut receptacle 26; securing the second fixed strut 21*b* within its receptacle 26 by means of a second detent pin 15; moving the pair of fixed struts 21*a*, 21*b* as needed to align the first cross-member 23 with the second cross member 25; inserting the free end of second cross-member 25 into the free end of first cross-member 23; securing the cross-member 23 and 25 sub-assembly by means of a third detent pin 15; installing the free end of each telescoping strut 31 and shoulder brace 33 sub-assembly into the upper end of each fixed strut 21*a*, 21*b*; securing each telescoping strut by means of a fourth and fifth detent pin 15; checking the assembled device 10 for comfort; performing adjustments, if and as necessary, by removing the appropriate detent pins 15; moving the movable members to align different adjusting apertures 19 with the detent apertures 16; reinstalling the detent pins 15 to secure the adjustment; loosening a first hand grip 27*a* by rotating it clockwise (as seen from the top); sliding the loosened hand grip 27*a* onto a comfortable location; tightening the first hand grip 27*a* counter-clockwise to firmly secure it in place; repeating these steps to adjust the opposite hand grip 27*b*; transporting the device 10 from the assembly site to a desired location; clearing the snow 61 from the desired location; removing snow 61 and other residue from all parts of the device 10; cleaning the device and storing it in an assembled state.

The method of utilizing the alternate device 40 may be achieved by first performing assembly and adjusting steps similar to those performed for the device 10; after installing the struts 21*a*, 21*b* and 31 and the cross-member 23 and 25 and securing the assemblies with the plurality of detent pins, the final assembly of the device 40 requires the following additional assembly steps: standing the snow blade 41 in an upright position against a wall or workbench structure; aligning the pair of guides 43 with the pair of guide devises 49; moving the chassis toward the standing snow blade 41 to engage the guides 43 into the guide devises 49; aligning the desired guide 43 adjusting apertures with the guide clevis 49 apertures; securing the snow blade 41 into the desired angle by inserting one (1) detent pin 15 through each of the guide devises 49 top aperture, through one (1) of each guide 43 adjusting apertures, and through the guide clevis 49 bottom aperture.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A manual snow plow comprising:

a scoop for pushing snow and debris from a surface, further comprising:

a receptacle having a pair of opposing side walls, a top, a transverse curved rear wall joining said side walls and said top, and an open face;

a blade attached to a lower end of said rear wall to scrape said surface and push said snow and debris into said receptacle; and, a means to adjustably secure said blade to said receptacle at a desired forward position and scraping angle, comprising:

a plurality of adjustment apertures in each side of said rear wall lower end arranged adjacent to and parallel to said receptacle side walls;

a pair of blade clamps affixed to opposing upper ends of said blade comprising a threaded aperture which aligns with an opposing pair of said plurality of adjustment apertures; and, a threaded fastener to secure said blade to said receptacle;

a frame pivotally attached to said scoop for transferring a force exerted by a user to said scoop, further comprising:

a pair of outer struts, wherein lower ends of said pair of outer struts are pivotally connected to said scoop;

a pair of inner struts, wherein lower ends of said pair of inner struts are in a telescoping relationship with open upper ends of said pair of outer struts;

a pair of curved shoulder braces pivotally connected to upper ends of said pair of inner struts;

a pair of hand grips adjustably attached to under side surfaces of said pair of outer struts; and, a pair of wheel assemblies for guiding said scoop over uneven areas of said surface:

a means to adjust a width of said frame to suit a particular shoulder width of said user; and, a means to adjust a height of said frame to suit a particular height of said user;

wherein said scoop comprises a means to pivotably attach said frame to said scoop; and, wherein said blade protrudes past a lower edge of said rear wall.

2. The plow of claim 1, wherein said wheel assemblies comprise:

a pair of caster brackets affixed to lower opposing outside ends of said rear wall; and, a pair of casters rotatingly attached to said pair of caster brackets.

3. The plow of claim 1, wherein said means to pivotably attach said frame to said scoop comprises:

a pair of strut clevis brackets attached at an upward angle to an exterior upper end of said receptacle rear wall to receive said outer strut lower ends; and, a pair of detent pins removably inserted through a pair of opposing clevis apertures and a pair of lower strut apertures to pivotally connect said pair of outer strut lower ends to said pair of strut clevis brackets.

4. The plow of claim 1, wherein said means to adjust a width of said frame to suit a particular shoulder width of said user further comprises:

an outer cross member clevis bracket affixed to an inside face of one of said pair of outer struts to receive an outer cross member;

a retainer pin inserted through a pair of opposing outer cross member clevis apertures and a pair of opposing outer cross member apertures to pivotally connect said outer cross member to said outer cross member clevis bracket;

an inner cross member clevis bracket affixed to an inside face of an opposing one of said pair of outer struts to receive an inner cross member;

a retainer pin inserted through a pair of opposing inner cross member clevis apertures and a pair of opposing inner cross member apertures to pivotally connect said inner cross member to said inner cross member clevis bracket; and, a detent pin removably inserted through one of a plurality of pairs of inner cross member fastening apertures and a pair of opposing outer cross member fastening apertures to secure said cross members in a telescoping relationship at a desired distance between said pair of outer struts.

5. The plow of claim 1, wherein said means to adjust a height of said frame to suit a particular height of said user further comprises:

a pair of opposing upper strut apertures in said pair of outer strut upper ends;

a plurality of pairs of opposing inner strut apertures in said inner strut lower ends; and, a pair of detent pins removably inserted through said pair of opposing upper strut apertures and one of said plurality of pairs of opposing inner strut apertures to secure said telescoping pairs of inner struts and pairs of outer struts at a desired length.

6. The plow of claim 1, wherein said pair of shoulder braces each comprise:

a brace clevis bracket to receive said inner strut upper end; and, a retainer pin inserted through a pair of opposing brace clevis apertures and a pair of opposing inner strut apertures in said inner strut upper end.

7. The plow of claim 6, wherein said pair of shoulder braces further comprise padding on an inner curved surface.

8. The plow of claim 1, wherein said pair of hand grips further comprise:

a grip post for being grasped by said user having a threaded upper end;

an adjustment rail affixed to said under side surface of each of said pair of outer struts, said adjustment rail comprising a length of C-shaped channel; and, a clamping washer which fits within said adjustment rail to threadingly receive said grip post upper end;

wherein said grip post is rotated to draw in said clamping washer, thus clamping C-shaped edges of said adjustment rail between said clamping washer and said grip post at a desired position on said adjustment rail.

9. The plow of claim 1, wherein said scoop comprises:

a shovel blade to scrape said surface;

a means to pivotably attach said frame to said shovel blade; and, an articulation means to selectively adjust a position of said shovel blade to a selectable angle in relation to said frame.

10. The plow of claim 9, wherein said articulation means comprises:

a pair of scoop clevis brackets affixed to a back side surface of said shovel blade;

a pair of guide clevis brackets affixed to opposing ends of an elongated connecting beam;

a pair of curved guide rails pivotally attached to said pair of scoop clevis brackets;

a pair of retaining pins inserted through a pair of opposing scoop clevis apertures and one of a plurality of guide rail apertures to pivotally connect said pair of guide rails to said pair of scoop clevis brackets; and, a pair of detent pins inserted through a pair of opposing guide clevis apertures and one of said plurality of guide rail apertures to pivotally connect said pair of guide rails to said pair of scoop clevis brackets to position said scoop at said selectable angle.

11. The plow of claim 10, wherein said a means to pivotably attach said frame to said scoop comprises:

a pair of strut clevis brackets affixed at an upward angle to a rear side of said connecting beam to pivotally receive said pair of outer strut lower ends; and, a pair of detent pins removably inserted through a pair of opposing strut clevis apertures and a pair of lower strut apertures to pivotally connect said pair of outer strut lower ends to said pair of strut clevis brackets.

12. The plow of claim 11, wherein said pair of wheel assemblies comprises:

a pair of caster brackets affixed to opposing ends of a bottom side of said connecting beam; and, a pair of casters rotatingly attached to said pair of caster brackets.

13. A manual snow plow comprising:

a scoop for pushing snow and debris from a surface;

a pair of outer struts, wherein a lower end of each is in a pivoting relationship with said scoop;

a pair of inner struts, wherein a lower end of each is in a telescoping relationship with open upper ends of said pair of outer struts;

a pair of curved shoulder braces pivotally connected to upper ends of said pair of inner struts, each comprising:

a brace clevis bracket to receive said inner strut upper end;

a retainer pin inserted through a pair of opposing brace clevis apertures and a pair of opposing inner strut apertures in said inner strut upper end; and, padding on an inner curved surface;

a means to adjust a height of said frame to suit a particular height of a user comprising:

a pair of opposing upper strut apertures in said pair of outer strut upper ends;

a plurality of pairs of opposing inner strut apertures in said inner strut lower ends; and, a pair of detent pins removably inserted through said pair of opposing upper strut apertures and one of said plurality of pairs of opposing inner strut apertures to secure said telescoping pairs of inner struts and pairs of outer struts at a desired length;

a means to adjust a width of said frame to suit a particular width of said user comprising:

an outer cross member clevis bracket affixed to an inside face of one of said pair of outer struts to receive an outer cross member;

a retainer pin inserted through a pair of opposing outer cross member clevis apertures and a pair of opposing outer cross member apertures to pivotally connect said outer cross member to said outer cross member clevis bracket;

an inner cross member clevis bracket affixed to an inside face of an opposing one of said pair of outer struts to receive an inner cross member;

a retainer pin inserted through a pair of opposing inner cross member clevis apertures and a pair of opposing inner cross member apertures to pivotally connect said inner cross member to said inner cross member clevis bracket; and, a detent pin removably inserted through one of a plurality of pairs of inner cross member fastening apertures and a pair of opposing outer cross member fastening apertures to secure said cross members in a telescoping relationship at a desired distance between said pair of outer struts;

a pair of hand grips adjustably attached to under side surfaces of said pair of outer struts comprising:

a grip post for being grasped by said user having a threaded upper end;

an adjustment rail comprising a length of C-shaped channel affixed to said under side surface of each of said pair of outer struts; and, a clamping washer fit within said adjustment rail to threadingly receive said grip post upper end;

wherein said grip post is rotated to draw in said clamping washer, thus clamping C-shaped edges of said adjustment rail between said clamping washer and said grip post at a desired position on said adjustment rail; and, a pair of wheel assemblies for guiding said scoop over uneven areas of said surface.

14. The plow of claim 13, wherein said scoop comprises:

a receptacle having a pair of opposing side walls, a top, a transverse curved rear wall joining said side walls and said top, and an open face; and, a blade attached to a lower end of said rear wall, said blade protruding past a lower edge of said rear surface;

a means for adjustably securing said blade to said receptacle at a desired forward position and scraping angle comprising:

a plurality of adjustment apertures in each side of said rear wall lower end arranged adjacent to and parallel to said receptacle side walls;

a pair of blade clamps affixed to opposing upper ends of said blades comprising a threaded aperture which aligns with an opposing pair of said plurality of adjustment apertures; and, a threaded fastener to secure said blade to said receptacle; and, a means to pivotably attach said frame to said scoop comprising:

a pair of strut clevis brackets attached at an upward angle to an exterior upper end of said receptacle rear wall to receive said outer strut lower ends; and, a pair of detent pins removably inserted through a pair of opposing clevis apertures and a pair of lower strut apertures to pivotally connect said pair of outer strut lower ends to said pair of strut clevis brackets;

wherein said wheel assemblies comprise:

a pair of caster brackets affixed to lower opposing outside ends of said rear wall; and, a pair of casters rotatingly attached to said pair of caster brackets.

15. The plow of claim 13, wherein said scoop comprises:

a shovel blade;

a means to pivotably attach said frame to said shovel blade; and, an articulation means to selectively adjust a position of said shovel blade to a selectable angle in relation to said frame comprising:

a pair of scoop clevis brackets affixed to a back side surface of said shovel blade;

a pair of guide clevis brackets affixed to opposing ends of an elongated connecting beam;

a pair of curved guide rails pivotally attached to said pair of scoop clevis brackets;

a pair of retaining pins inserted through a pair of opposing scoop clevis apertures and one of a plurality of guide rail apertures to pivotally connect said pair of guide rails to said pair of scoop clevis brackets; and, a pair of detent pins inserted through a pair of opposing guide clevis apertures and one of said plurality of guide rail apertures to pivotally connect said pair of guide rails to said pair of scoop clevis brackets to position said scoop at said selectable angle;

a means to pivotably attach said frame to said shovel blade comprises:

a pair of strut clevis brackets affixed at an upward angle to a rear side of said connecting beam to pivotally receive said pair of outer strut lower ends; and, a pair of detent pins removably inserted through a pair of opposing strut clevis apertures and a pair of lower strut apertures to pivotally connect said pair of outer strut lower ends to said pair of strut clevis brackets; and, wherein said pair of wheel assemblies comprises:

a pair of caster brackets affixed to opposing ends of a bottom side of said connecting beam; and, a pair of casters rotatingly attached to said pair of caster brackets.

16. A method of manually plowing snow utilizing a manual snow plow comprising the steps of:

providing a manual snow plow comprising:

a scoop for pushing snow and debris from a surface, further comprising:

a receptacle having a pair of opposing side walls, a top, a transverse curved rear wall joining said side walls and said top, and an open face;

a blade attached to a lower end of said rear wall to scrape said surface and push said snow and debris into said receptacle; and, a means to adjustably secure said blade to said receptacle at a desired forward position and scraping angle, comprising:

a plurality of adjustment apertures in each side of said rear wall lower end arranged adjacent to and parallel to said receptacle side walls;

a pair of blade clamps affixed to opposing upper ends of said blade comprising a threaded aperture which aligns with an opposing pair of said plurality of adjustment apertures; and, a threaded fastener to secure said blade to said receptacle;

a frame pivotally attached to said scoop for transferring a force exerted by a user to said scoop, further comprising:

a pair of outer struts, wherein lower ends of said pair of outer struts are pivotally connected to said scoop;

a pair of inner struts, wherein lower ends of said pair of inner struts are in a telescoping relationship with open upper ends of said pair of outer struts;

a pair of curved shoulder braces pivotally connected to upper ends of said pair of inner struts;

a pair of hand grips adjustably attached to under side surfaces of said pair of outer struts; and, a pair of wheel assemblies for guiding said scoop over uneven areas of said surface;

a means to adjust a width of said frame to suit a particular shoulder width of said user; and, a means to adjust a height of said frame to suit a particular height of said user;

wherein said scoop comprises a means to pivotably attach said frame to said scoop; and, wherein said blade protrudes past a lower edge of said rear wall;

pivotally attaching an individual lower end of said pair of outer struts into corresponding strut clevis brackets by means of a pair of removable detent pins;

moving said pair of outer struts as needed to align said an outer cross member with an inner cross member;

inserting a free end of said inner cross member into an open end of said outer cross member;

securing said cross members by means of a removal detent pin;

installing a lower end free end of said pair of inner struts into an upper end of said pair of outer struts;

securing said pairs of struts in a telescoping relationship by means of a pair of removable detent pins;

performing adjustments, if and as necessary, to adjust a connected length of said outer and inner cross members to correspond to a shoulder width of a user;

performing adjustments, if and as necessary, to adjust a connected length of said outer and inner struts to correspond to a shoulder height of a user;

positioning said pair of hand grips by rotating and sliding a loosened hand grip to a comfortable location within a pair of adjustment rails;

tightening said pair of hand grips by counter-rotating to secure in place with said pair of adjustment rails;

placing shoulders of said user within said pair of pivoting shoulder braces;

grasping said pair of hand grips;

driving said manual snow plow utilizing a driving force exerted by the body of said user; and, clearing an amount of snow and debris from a desired surface location.

17. The method of claim 16, wherein said manual snow plow comprises an articulation means to selectively adjust a position of said scoop to a selectable angle in relation to said frame, comprising the additional steps of:

pivotally attaching a pair of guide rails to a pair of scoop clevis brackets by means of a pair of retaining pins;

positioning said scoop at said selectable angle in relation to said frame; and, attaching said pair of guide rails to a pair of guide clevis brackets by means of a pair of removable detent pins.

* * * * *